US012410593B2

(12) United States Patent
Thurmond et al.

(10) Patent No.: US 12,410,593 B2
(45) Date of Patent: Sep. 9, 2025

(54) MOUNTING ASSEMBLY FOR USE WITH A PLUMBING FIXTURE

(71) Applicant: Gulfstream Aerospace Corporation, Savannah, GA (US)

(72) Inventors: Richard Thurmond, Savannah, GA (US); Robert Telmos, Savannah, GA (US)

(73) Assignee: GULFSTREAM AEROSPACE CORPORATION, Savannah, GA (US)

( * ) Notice: Subject to any disclaimer, the term of this patent is extended or adjusted under 35 U.S.C. 154(b) by 240 days.

(21) Appl. No.: 18/184,151

(22) Filed: Mar. 15, 2023

(65) Prior Publication Data

US 2024/0309619 A1 Sep. 19, 2024

(51) Int. Cl.
*E03C 1/04* (2006.01)
*E03C 1/02* (2006.01)

(52) U.S. Cl.
CPC ..... *E03C 1/0402* (2013.01); *E03C 1/023* (2013.01)

(58) Field of Classification Search
CPC ..... E03C 1/0402; E03C 1/023; E03C 1/0401
USPC ..... 4/695–696
See application file for complete search history.

(56) References Cited

U.S. PATENT DOCUMENTS 5,375,272 A * 12/1994 Mikol ..... E03C 1/0402 137/359
5,465,749 A * 11/1995 Sauter ..... F16L 41/16 137/315.15
9,032,985 B2 * 5/2015 Lloyd ..... F16L 3/12 137/15.01
9,551,135 B2 * 1/2017 Bors ..... E03C 1/0401
2002/0120984 A1 * 9/2002 Gray ..... E03C 1/23 4/684
2004/0154673 A1 * 8/2004 Mascari ..... E03C 1/0402 137/801
2005/0251907 A1 * 11/2005 Mintz ..... E03C 1/0401 4/695
2012/0067978 A1 * 3/2012 Leichty ..... E03C 1/0403 239/417.5
2013/0186479 A1 * 7/2013 Zhu ..... E03C 1/06 137/15.01
2014/0230144 A1 * 8/2014 Bors ..... E03C 1/0401 4/695
2015/0219245 A1 * 8/2015 Bors ..... F16L 3/16 248/70
2017/0101325 A1 * 4/2017 Ye ..... B01D 35/046
2018/0195256 A1 * 7/2018 L'Henaff ..... E03C 1/042

FOREIGN PATENT DOCUMENTS

CA 2813182 A1 * 8/2014 ..... E03C 1/0401
GB 2585706 A * 1/2021 ..... E03C 1/00

* cited by examiner

*Primary Examiner* — Lori L Baker
(74) *Attorney, Agent, or Firm* — Ingrassia Fisher & Lorenz, LLP

(57) ABSTRACT

A mounting assembly for use with a plumbing fixture. The plumbing fixture is configured to be mounted within an opening in a body, such as a countertop or a sink surround. The mounting assembly includes, but is not limited to, a first portion that is configured to engage the plumbing fixture and to secure the plumbing fixture within the opening in the body. The mounting assembly further includes, but is not limited to, a second portion that is configured to be releasably coupled with the first portion.

20 Claims, 8 Drawing Sheets

MOUNTING ASSEMBLY FOR USE WITH A PLUMBING FIXTURE

TECHNICAL FIELD OF THE INVENTION

The technical field relates generally to plumbing and more particularly relates to a mounting assembly for use with a plumbing fixture wherein the mounting assembly facilitates removal and replacement and/or exchange of the visible portions of the mounting assembly and associated hardware.

BACKGROUND OF THE INVENTION

Plumbing fixtures that deliver water, for example, to sinks and tubs are mounted to such sinks and tubs or to counters and/or surrounds associated with such sinks and tubs, via mounting members that are associated with faucet assemblies. These faucet assemblies commonly include handles and spouts for operating the plumbing fixtures and dispensing the water. Conventionally, a plumbing fixture is fluidly coupled with a fluid source. In an example, the plumbing fixture includes a valve to control the flow of the fluid through the plumbing fixture. The valve permits the fluid to flow when the valve is opened and inhibits the fluid from flowing when the valve is closed. The handles of such faucet assemblies are configured to be engaged with by the hand of a human operator at one end and to engage with the valve of the plumbing fixture at the other end. When a human operator rotates, manipulates, or otherwise operates the handle, the handle opens the valve and permits the fluid to flow through the plumbing fixture to the spout from which it is discharged into, for example, a sink.

Conventionally, a plumbing fixture is positioned within an opening in a countertop, a sink, a tub, a surround or other surface and is secured by a mounting member that is associated with either the handle or the spout or both. In conventional embodiments, the mounting member comprises a decorative bezzle that is configured to mount a bottom portion of the handle or spout. In the case of a handle, the bezzle is rotationally coupled to the handle such that the handle can rotate with respect to the bezzle. In the case of a spout, the bezzle may or may not be configured to mount the spout in a non-rotating matter.

To mount the plumbing fixture to the sink, the sink surround, the countertop, or to some other body, the bezzle includes threads along, for example, an inner diameter, and the plumbing fixture is placed in threaded engagement with the bezzle. The plumbing fixture includes a flange or other mounting feature that is designed to cooperate with the bezzle to mount the plumbing fixture to the countertop, sink, or other body. The bezzle is disposed on one side of the countertop, sink, sink surround, or other body while the mounting feature is disposed on the opposite side. When the plumbing fixture is screwed into the bezzle, the bezzle and the mounting feature compress against opposite sides of the countertop, sink, sink surround, or other body to mount the plumbing fixture within the opening of the body.

From time to time, the bezzle, the handle and/or the spout may need to be removed and replaced. Conventionally, this involves unscrewing the bezzle from the plumbing fixture which entails undesirable complications. Such complications range from requiring the use of special tools, needing to reach into confined spaces, a person needing to place his or her body in awkward positions, and needing two or more workers in order to separate the bezzle from the plumbing fixture without damaging the plumbing fixture which would be free to fall through the opening once the bezzles is unscrewed and removed. While these concerns can be addressed by conventional means, there is room for improvement.

Accordingly, it is desirable to provide an assembly that is configured to address one or more of the foregoing issues. Furthermore, other desirable features and characteristics of the various embodiments described herein will become apparent from the subsequent detailed description and the appended claims, taken in conjunction with the accompanying drawings and this background.

SUMMARY OF THE INVENTION

Various non-limiting embodiments of a mounting assembly for use with a plumbing fixture are disclosed herein. The plumbing fixture is configured to be mounted within an opening in a body. The various non-limiting embodiments of the mounting assembly are described below.

In a first non-limiting embodiment, the mounting assembly includes, but is not limited to, a first portion that is configured to engage the plumbing fixture and to secure the plumbing fixture within the opening in the body. The mounting assembly further includes, but is not limited to, a second portion that is configured to be releasably coupled with the first portion.

In a second, non-limiting embodiment, the mounting assembly includes, but is not limited to, a first portion that is configured to engage the plumbing fixture and to secure the plumbing fixture within the opening in the body. The mounting assembly further includes a second portion that is configured to be releasably coupled with the first portion. The mounting assembly still further includes, but is not limited to, a handle.

In another non-limiting embodiment, the mounting assembly includes, but is not limited to, a first portion that is configured to engage the plumbing fixture and to secure the plumbing fixture within the opening in the body. The mounting assembly further includes, but is not limited to, a second portion that is configured to be releasably coupled with the first portion. In this non-limiting embodiment, the second portion comprises a spout.

Further areas of applicability will become apparent from the description provided herein. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
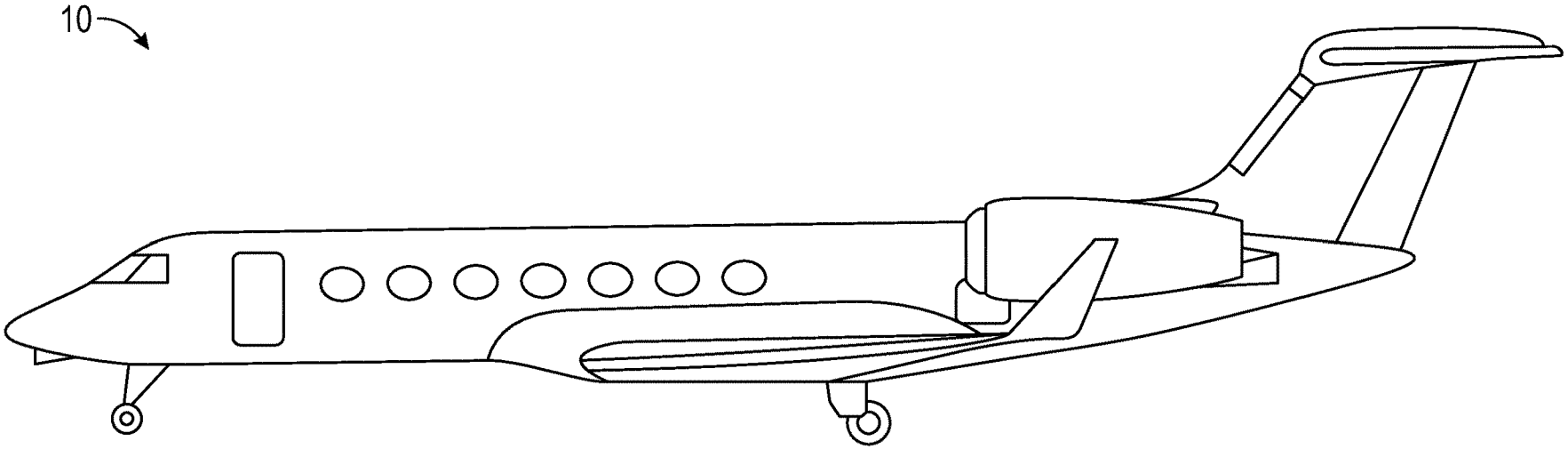
FIG. 1 is a side view illustrating an exemplary aircraft suitable for use with embodiments of the mounting assembly of the present disclosure.

Example embodiments will now be described more fully with reference to the accompanying drawings.

An improved mounting assembly is disclosed herein that addresses the concerns expressed above in the Background Section. In a non-limiting embodiment, the mounting assembly of the present disclosure uses two components to mount a plumbing fixture to a body such as a sink, a sink surround, a tub, a countertop or the like rather than a conventional mounting assembly that uses only a single component. Whereas the single component of a conventional mounting assembly serves both a decorative and a mechanical coupling function, the mounting assembly of the present disclosure assigns those two functions to two separate components. The mounting assembly disclosed herein includes a coupling portion that mechanically couples the plumbing fixture to the sink, surround or other body. The coupling portion is hidden from view by a visible portion when the mounting assembly is fully installed. The visible portion may have decorative or ornamental contours and/or features to create an aesthetically pleasing appearance. At the same time, the visible portion shields the coupling portion from dirt, grime, and other contaminants.

The coupling portion is configured to engage the plumbing fixture, such as through threaded engagement, and to mount the plumbing fixture to a body such as a sink, a sink surround, a countertop or the like. The visible portion is configured to be releasably engaged with the coupling portion, to conceal the coupling portion, and in some embodiments, to engage with another component such as a faucet handle or a faucet spout. In some embodiments, the visible portion may comprise the faucet handle or the faucet spout. The releasable engagement between the visible portion and the coupling portion may be achieved through any suitable or conventional means such as, but not limited to, the use of threaded fasteners.

The releasable engagement between the visible portion and the coupling portion resolves the concerns expressed in the Background Section above. By being able to easily detach the visible portion from the coupling portion, a worker may replace the decorative/ornamental portions of a faucet assembly without any need to remove, dislocate, or otherwise disturb the plumbing fixture. Thanks to the plumbing fixture's undisturbed and continuous engagement with the coupling portion, the plumbing fixture remains statically in place and, in turn, undamaged while the decorative components of a faucet assembly are changed out or replaced on any number of occasions. This solution greatly facilitates the ability to update and renovate faucet assemblies or to simply replace them if they become damaged, corroded or otherwise decayed.

In addition, the teachings of the present disclosure are not limited to only those sink assemblies where the spouts and the handles are separate components. Rather, the teachings of the present disclosure apply with equal force to faucet assemblies where the handle and the spout are combined into a single integrated component.

A further advantage of the present invention is that no special tools or skills are required to change out the visible portion of the mounting assembly. Rather, an unskilled person using only a commonly available screwdriver is enabled by the mounting assembly disclosed herein to change out the visible portion of each and every faucet assembly in his/her dwelling without any special tools or training.

A greater understanding of the mounting assembly discussed above may be obtained through a review of the illustrations accompanying this application together with a review of the detailed description that follows.

FIG. 1 is a side view illustrating an exemplary aircraft 10 that is suitable for use with embodiments of the mounting assembly of the present disclosure. It should be understood that although embodiments of the mounting assembly disclosed herein are illustrated in the context of an aircraft, it should be understood that the mounting assembly is not limited to usage onboard an aircraft. Rather, it should be understood that the mounting assembly disclosed herein may be used onboard any vehicle that is configured to travel on land, air, sea, or outer space. Further, it should be understood that use of the mounting assembly disclosed herein is not limited to use in connection with a vehicle. Rather, the mounting assembly disclosed herein may be used in conjunction with plumbing fixtures in any and all applications where plumbing fixtures may be employed.

Figure 2:
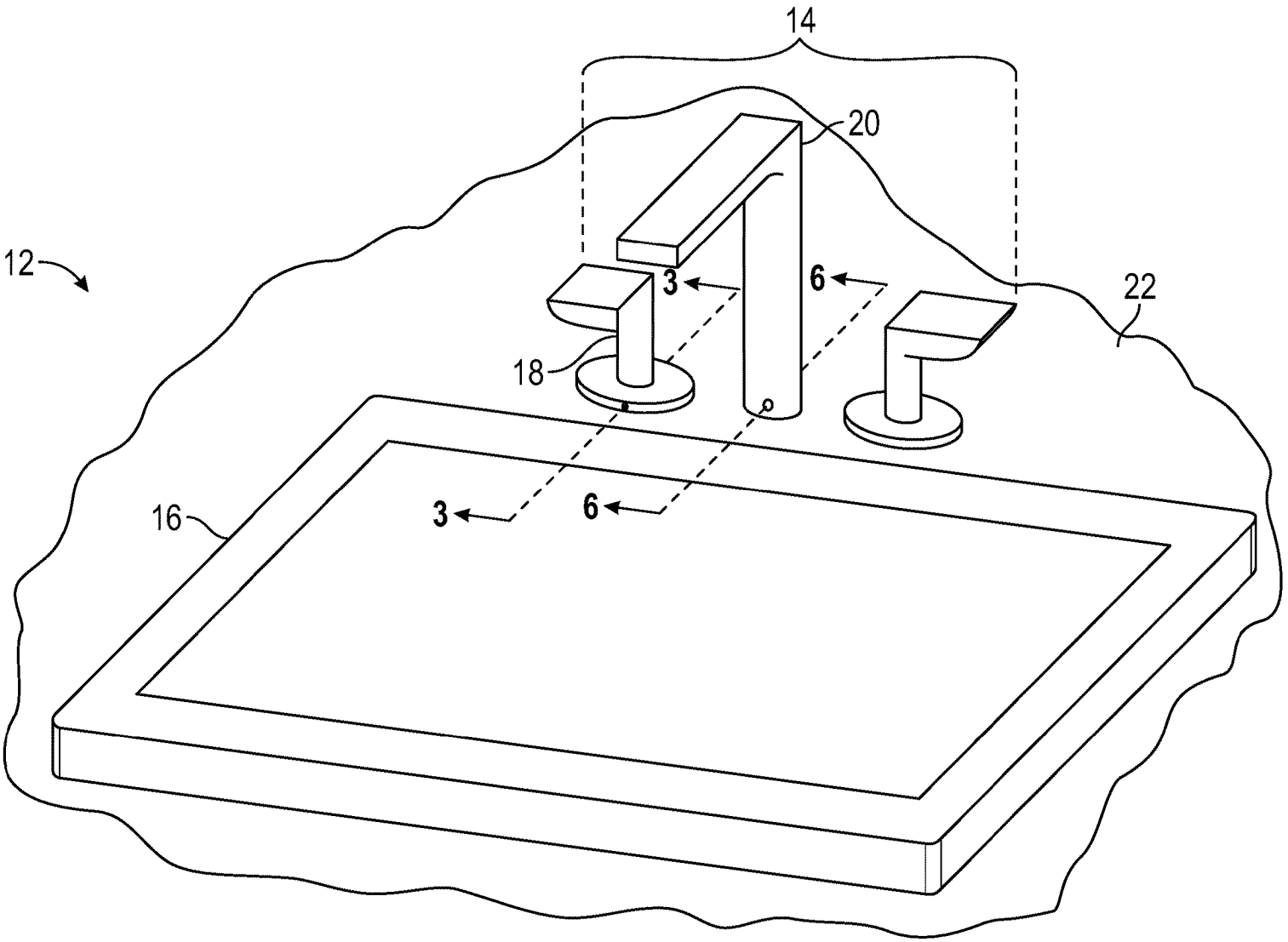
FIG. 2 is a perspective view illustrating an exemplary counter or surround suitable for use with embodiments of the mounting assembly of the present disclosure.

With continuing reference to FIG. 1, FIG. 2 is a perspective view illustrating a sink 12. Sink 12 may be associated with a galley and/or a lavatory onboard aircraft 10. Sink 12 includes a faucet assembly 14 and a bowl 16. Faucet assembly 14 includes a handle 18 and a spout 20, as well as associated mounting assemblies (See FIGS. 3-7) and associated plumbing fixtures (see FIGS. 3, 5-7), discussed below. An operator may engage handle 18 by rotating it. Such rotation will actuate a valve in an associated plumbing fixture and cause fluid (e.g., water) to flow through spout 20 and dispensed into bowl 16. In the illustrated embodiment, faucet assembly 14 is mounted in countertop 22 immediately adjacent to bowl 16. Accordingly, countertop 22 is configured with openings to receive faucet assembly 14.

Figure 2A:
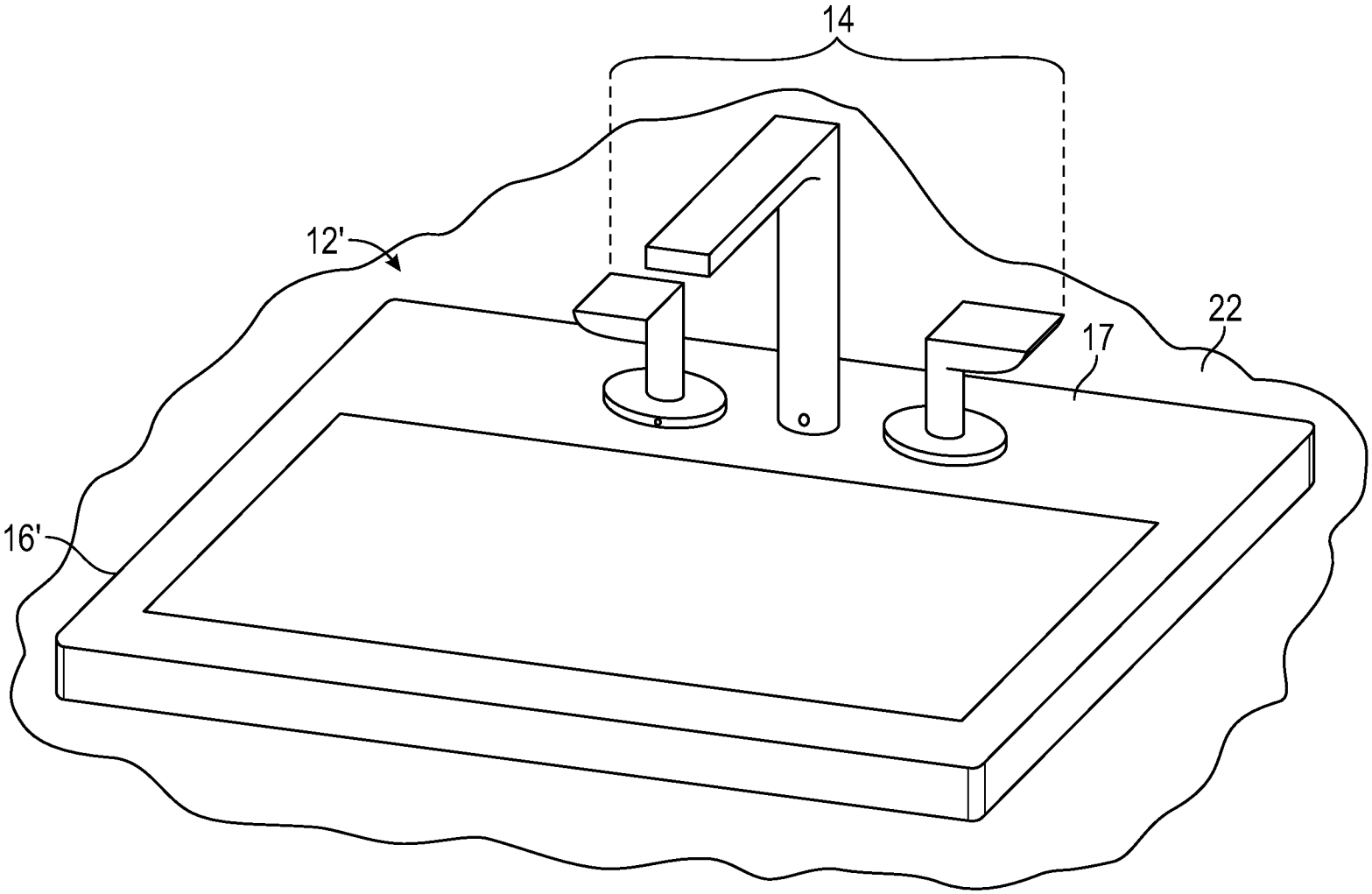
FIG. 2A is a perspective view illustrating another exemplary embodiment of a sink or tub suitable for use with embodiments of the mounting assembly of the present disclosure.

With continuing reference to FIGS. 1-2, FIG. 2A is a perspective view illustrating a sink 12' which is an alternate embodiment of sink 12. Sink 12' differs from sink 12 in that sink 12' includes a bowl 16' having a surround 17 that is integral with bowl 16'. Faucet assembly 14 is mounted into surround 17. Accordingly, surround 17 is configured with openings that are configured to receive faucet assembly 14. While FIGS. 2 and 2A illustrate the mounting assembly of the present disclosure employed in an application involving a sink, it should be understood that the mounting assembly of the present disclosure may also be employed in other plumbing applications including, but not limited to, bath tubs and shower stalls.

Figure 3:
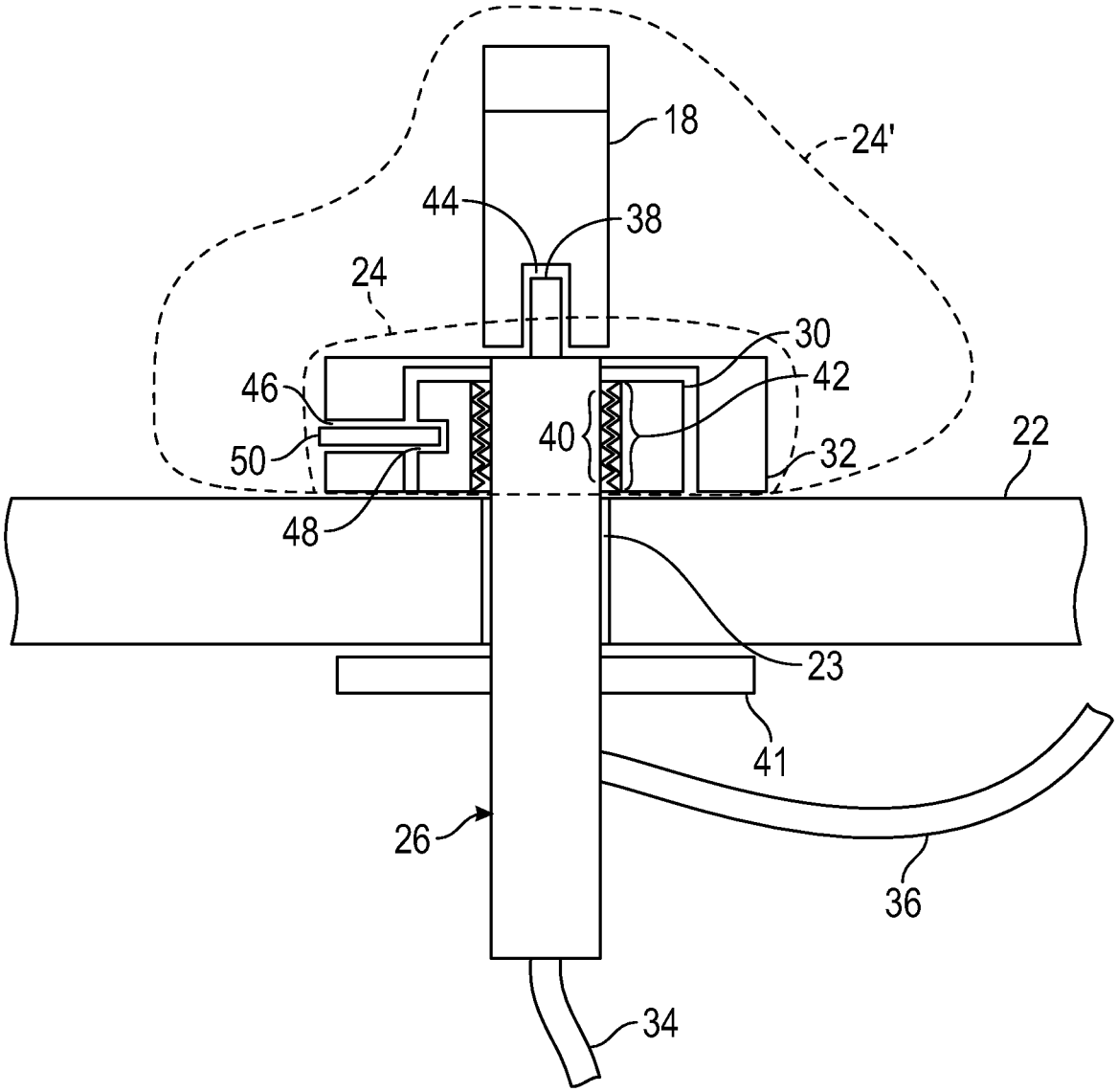
FIG. 3 is a schematic cross-sectional view illustrating two non-limiting embodiments of the mounting assembly of the present disclosure engaged with a plumbing fixture.
Figure 4:
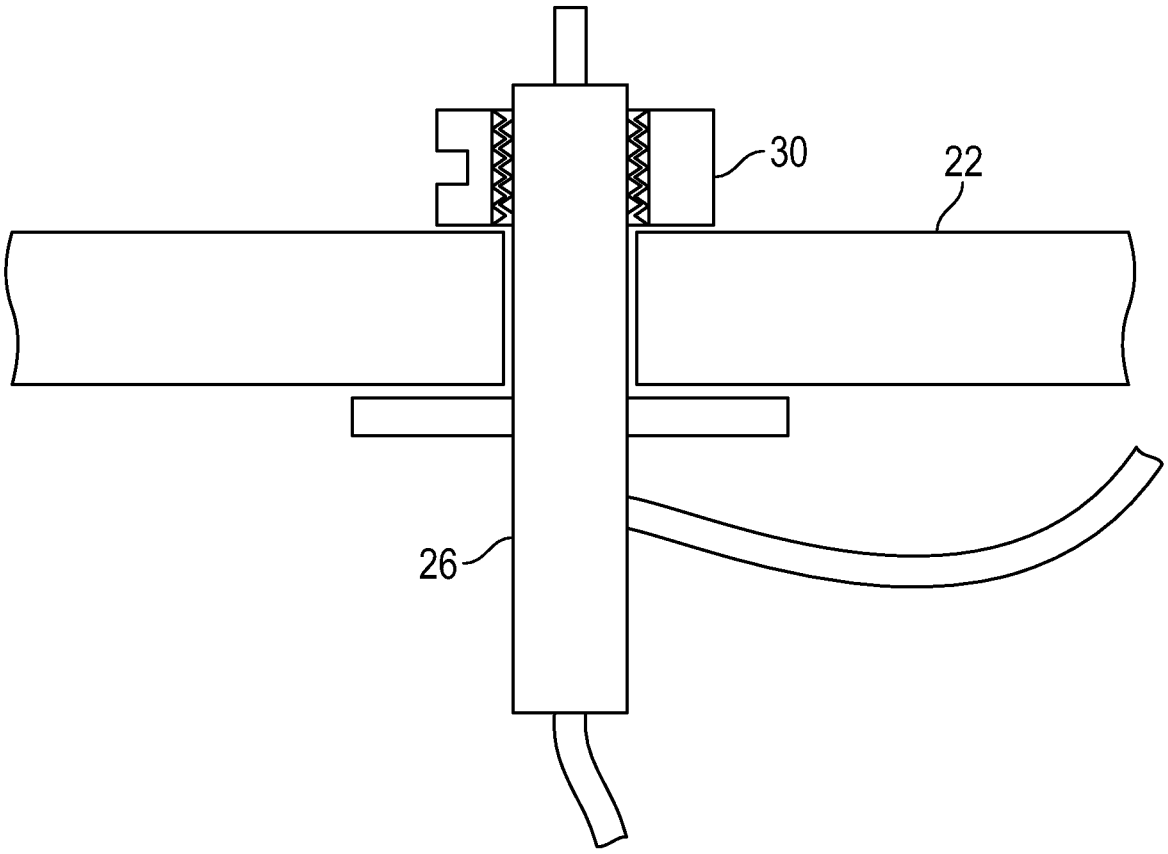
FIG. 4 is a schematic cross-sectional view illustrating the mounting assemblies of FIG. 3 in a partially disassembled state ready to receive a new/replacement bezzle and faucet handle.

With continuing reference to FIGS. 1-2A, FIG. 3 is a schematic cross-sectional view taken across line 3-3 of FIG. 2. FIG. 3 illustrates handle 18, a mounting assembly 24, a mounting assembly 24', countertop 22, and a plumbing fixture 26. The various components illustrated in FIG. 3 have been illustrated in a manner that depicts gaps between the components. These gaps have been depicted for ease of illustration to better show the relationship between the components and to better show the contours of the components. It should be understood that in embodiments intended for implementation, the various components would be more tightly drawn up against one another and in some embodiments, would be in direct contact with one another.

Mounting assembly 24 includes a mounting portion 30 (alternately referred to herein as a "first portion") and a cover portion 32 (alternately referred to herein as a "second portion"). Mounting assembly 24' includes mounting portion 30 (alternately referred to herein as a "first portion"), cover portion 32 (alternately referred to herein as a "second portion"), and handle 18. In an exemplary embodiment, mounting portion 30 and cover portion 32 are constructed of a metal material. In other embodiments, mounting portion 30 and cover portion 32 may be constructed from any other suitable material that is effective to mount plumbing fixture 26 to countertop 22.

In the illustrated embodiment, mounting portion 30 and cover portion 32 each have an annular configuration. In other embodiments, mounting portion 30 and cover portion 32 may have any other suitable geometric configuration that is effective to mount plumbing fixture 26 to sink 12 or 12'. In the illustrated embodiment, mounting portion 30 has a flat lower surface that is configured to rest in flush engagement with an upper surface of countertop 22 and that is further configured to nest within cover portion 32. In this manner, when mounting assembly 24 is assembled to handle 18 and has mounted plumbing fixture 26 to countertop 22, cover portion 32 will completely conceal mounting portion 30 from view. In some embodiments, cover portion 32 may serve a decorative purpose and may have an aesthetically pleasing contour/configuration that enhances the overall appearance of faucet assembly 14. For example, cover portion 32 may have an outward appearance of a bezzle. In other embodiments, cover portion 32 may have a more utilitarian appearance. Regardless of its ornamental function, cover portion 32 protects mounting portion 30 from dirt, grime, and other contaminants.

In the illustrated embodiment, plumbing fixture 26 comprises a valve assembly that is fluidly coupled with a water source via a conduit 34 and that is further configured to deliver water to spout 20 via conduit 36 when its valve (not shown) is open. Plumbing fixture 26 includes a valve stem 38 that is operatively coupled with the valve. In the illustrated embodiment, valve stem 38 may be actuated by rotation. Plumbing fixture 26 includes a plurality of threads 40 along an outer diameter that are configured to facilitate the mounting of plumbing fixture 26 to a body such as countertop 22. Plumbing fixture 26 further includes a mounting flange 41 that further facilitates the mounting of plumbing fixture 26 to a body, as discussed below.

A conventional bezzle serves two primary functions, those being to mount a plumbing fixture to a body (such as a sink or countertop) and to rotatably mount a handle in a position to engage the plumbing fixture. Mounting assembly 24 divides two functions and assigns them to two separate components. Mounting assembly 24 assigns the function of mounting a plumbing fixture to a body to mounting portion 30 and assigns the function of rotatably mounting a handle in a position to engage the plumbing fixture to cover portion 32.

As discussed above, mounting portion 30 has an annular configuration. Mounting portion 30 has an inner diameter having a plurality of threads 42 disposed along a surface defining its inner diameter. Plurality of threads 42 are configured to engage plurality of threads 40. In this manner, mounting portion 30 can be screwed into threaded engagement with plumbing fixture 26. Countertop 22 has an opening that defines a hole 23. In FIG. 3, plumbing fixture 26 is disposed within hole 23 and plurality of threads 42 are in threaded engagement with plurality of threads 40. As mounting portion 30 and plumbing fixture 26 are screwed into threaded engagement with one another, mounting portion 30 and mounting flange 41 are pulled towards one another. As mounting portion 30 and mounting flange 41 are pulled towards one another, a lower surface of mounting portion 30 and an upper surface of mounting flange 41 cooperate to compress countertop 22. In this manner, mounting portion 30 mounts plumbing fixture 26 to countertop 22.

Cover portion 32 is configured to rotatably mount handle 18 to cover portion 32. Methods by which handle 18 may be rotatably mounted to cover portion 32 are well known in the art and may be accomplished in any suitable or conventional manner that is effective to mount handle 18 over cover portion 32 in a manner that permits handle 18 to rotate with respect to cover portion 32. When cover portion 32 is coupled with mounting portion 30, valve stem 38 protrudes above an upper surface of cover portion 32. Handle 18 includes a recess 44 that is configured to engage with valve stem 18 such that when handle 18 is rotated by a user, handle 18 causes the rotation of valve stem 38 which, in turn, actuates the valve in plumbing fixture 26 and permits water to flow from conduit 34 to and through conduit 36.

In the illustrated embodiment, cover portion 32 includes an opening 46 that extends laterally entirely through an outer wall of cover portion 32. In addition, mounting portion 30 includes a cavity 48 that extends laterally into a wall of mounting portion 30. Cavity 48 is disposed in a position that aligns with opening 48 when cover portion 32 is coupled with mounting portion 30. In the illustrated embodiment, a mounting member 50 extends through opening 46 and into cavity 48. In this manner, mounting member 50 affixes cover portion 32 with respect to mounting portion 30. In some embodiments, cover portion 32 may include a plurality of openings 46 and mounting portion 30 may include a corresponding plurality of cavities 48 that are disposed to align with plurality of openings 46. In such embodiments, a plurality of mounting members 50 may be employed to affix cover portion 32 in position with respect to mounting portion 30. In some embodiments, mounting member 50 may comprise a threaded fastener, such as a flat head screw, a Phillips head screw, a hex head screw or the like, and either or both opening 46 and cavity 48 may include threads to engage with such threaded fastener. In other embodiments, any other suitable mechanism that is effective to retain cover portion 32 to mounting portion 30 may be used instead of the above described mounting member 50. For example, and without limitation, retaining rings, pins or buttons may be employed.

So long as mounting member 50 remains in place withing cavity 48, cover portion 32 will remain affixed with respect to mounting portion 30. If handle 18 or cover portion 32 ever become damaged or if for any other reason, an unskilled user decides to change out cover portion 32 and handle 18 (for example, to install a new cover portion and handle having a different appearance or a more pleasing ornamental design), then all that the unskilled user would need to do would be to remove mounting member 50 from cavity 48. With mounting member 50 removed from cavity 48, cover portion 32 and handle 18 may be decoupled from mounting portion 30. When this occurs, mounting portion 30 remains in threaded engagement with plumbing fixture 26 and plumbing fixture 26 remains undisturbed during the changeout or replacement of cover portion 32 and handle 18.

With continuing reference to FIGS. 1-3, FIG. 4 is a schematic cross-sectional view illustrating the continued engagement between mounting portion 30 and plumbing fixture 26 and, consequently, the undisturbed mounting of plumbing fixture 26 to countertop 22, after mounting member 50 has been removed from cavity 48 and both cover portion 32 and handle 18 have been separated from mounting portion 30. This permits the plumbing fixture's fluid couplings to remain undisturbed during a change-out of decorative components. A new cover portion and a new handle may now be mounted to mounting portion 30 simply by positioning the new cover portion and handle over mounting portion 30 and re-inserting mounting member 50. This can be accomplished by an individual who is not skilled in the art of conventional plumbing procedures. The various components illustrated in FIG. 4 have been illustrated in a manner that depicts gaps between the components. These gaps have been depicted for ease of illustration to better show the relationship between the components and to better show the contours of the components. It should be understood that in embodiments intended for implementation, the various components would be more tightly drawn up against one another and in some embodiments, would be in direct contact with one another.

Figure 5:
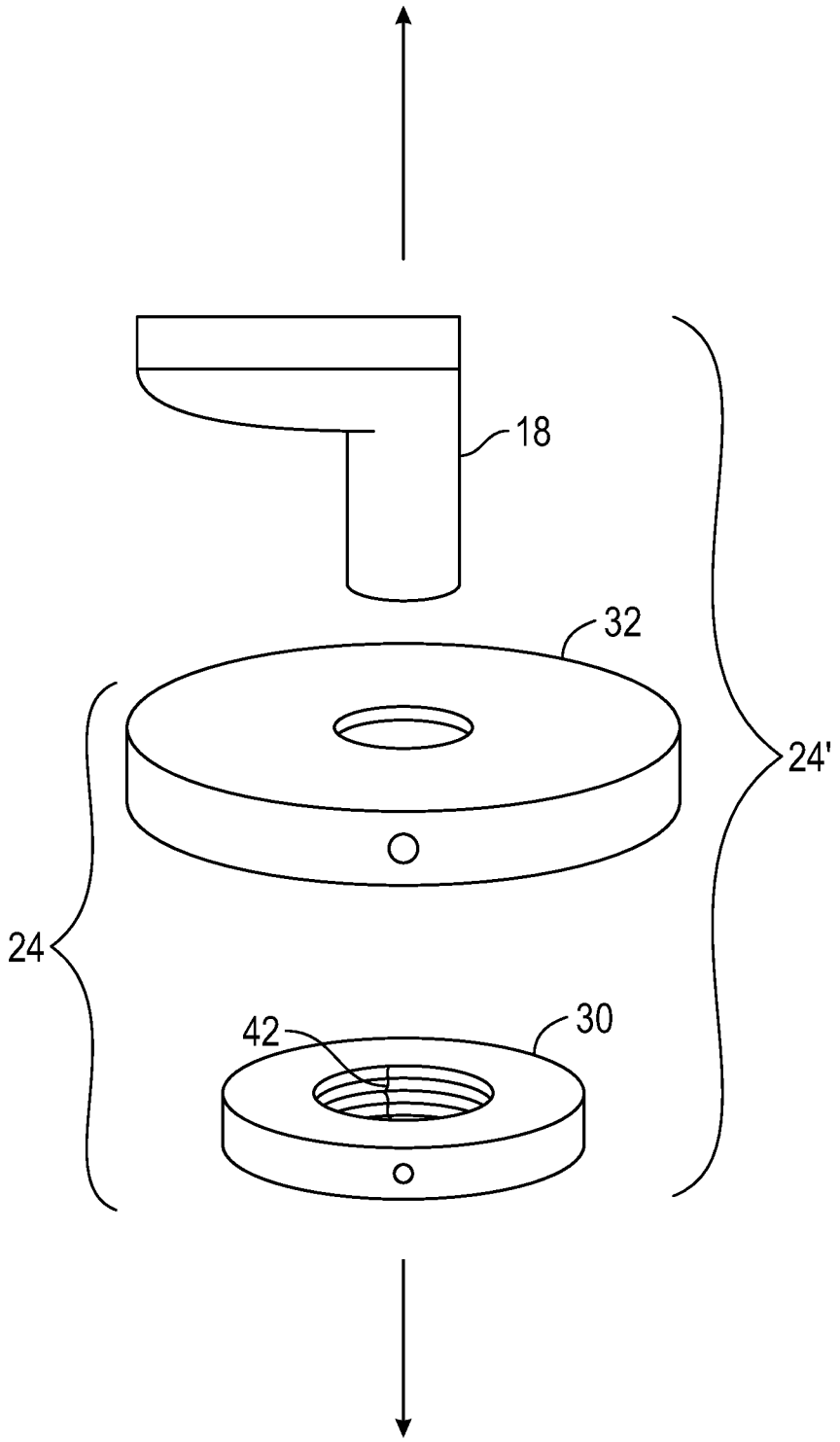
FIG. 5 is an exploded view of the mounting assemblies of FIG. 3.

With continuing reference to FIGS. 1-4, FIG. 5 is an exploded view of handle 18, mounting assembly 24, and mounting assembly 24'. In this view, the annular configuration of both mounting portion 30 and cover portion 32 can be observed. Also observable in FIG. 5 are the plurality of threads 42 which are disposed along an inner wall that defines an inner diameter of mounting portion 30.

Figure 6:
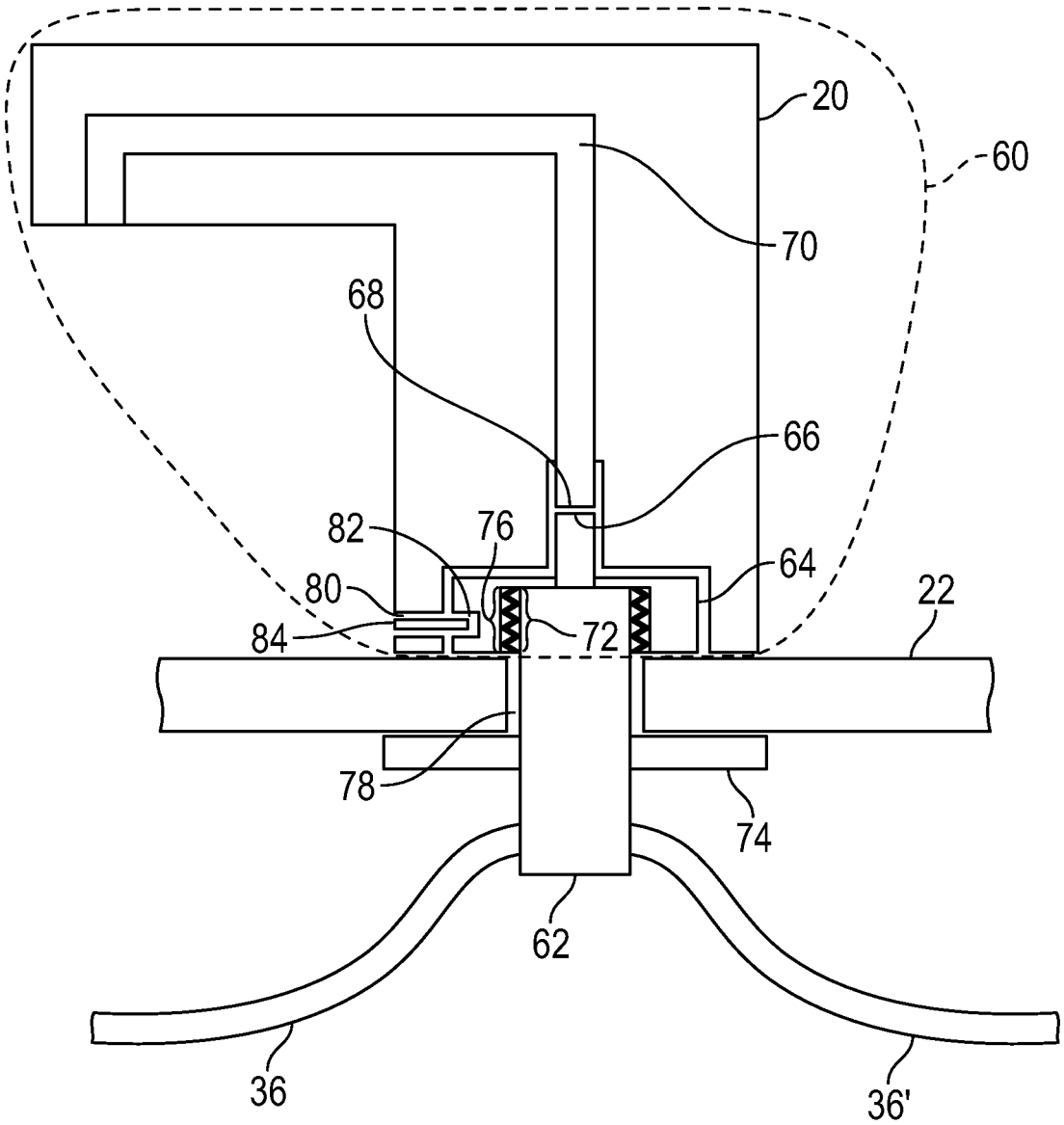
FIG. 6 is a schematic cross-sectional view illustrating another non-limiting embodiment of the mounting assembly of the present disclosure engaged with a plumbing fixture.
Figure 7:
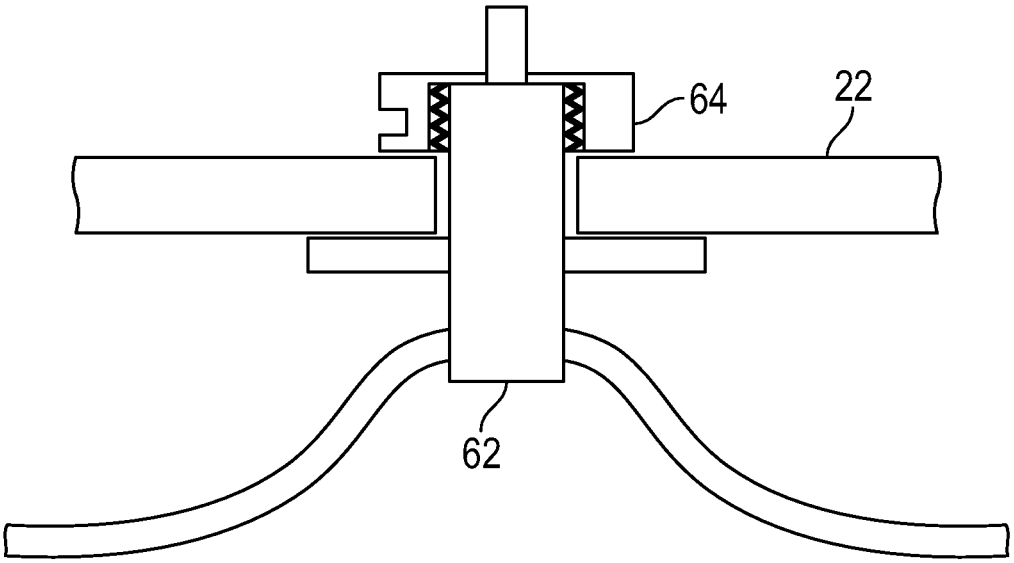
FIG. 7 is a schematic cross-sectional view illustrating the mounting assembly of FIG. 6 partially disassembled and configured to receive a new/replacement spout.

With continuing reference to FIGS. 1-5, FIG. 6 is a schematic cross-sectional view taken across line 6-6 of FIG. 2. FIG. 6 illustrates a mounting assembly 60, spout 20, countertop 22, and a plumbing fixture 62. The various components illustrated in FIG. 6 have been illustrated in a manner that depicts gaps between the components. These gaps have been depicted for ease of illustration to better show the relationship between the components and to better show the contours of the components. It should be understood that in embodiments intended for implementation, the various components would be more tightly drawn up against one another and in some embodiments, would be in direct contact with one another.

Mounting assembly 60 includes a mounting portion 64 and spout 20 which, in the illustrated embodiment, also comprises the cover portion. In other embodiments, a separate component having the appearance of a bezzle, for example, may serve as the cover portion and spout 20 may be mounted to such separate component without departing from the teachings of the present disclosure. In an exemplary embodiment, mounting portion 64 and spout 20 are constructed of a metal material. In other embodiments, mounting portion 64 and spout 20 may be constructed from any other suitable material that is effective to mount plumbing fixture 62 to countertop 22.

In the illustrated embodiment, mounting portion 64 has an annular configuration while the cover portion, spout 20, is configured as a spout for dispensing fluid. In the illustrated embodiment, mounting portion 64 has a flat lower surface that is configured to rest in flush engagement with an upper surface of countertop 22 and that is further configured to nest within spout 20. In this manner, when mounting assembly 60 has mounted plumbing fixture 62 to countertop 22, spout 20 will conceal mounting portion 64 from view. In some embodiments, spout 20 may serve a decorative purpose as well as a functional purpose. With this in mind, it may have an aesthetically pleasing contour/configuration that enhances the overall appearance of faucet assembly 14. In other embodiments, spout 20 may have a utilitarian appearance. Regardless of its ornamental function, spout 20 protects mounting portion 64 from dirt, grime, and other contaminants.

In the illustrated embodiment, plumbing fixture 62 performs a fluid mixing function. Plumbing fixture 62 is configured to receive a hot water stream and a cold water stream from other plumbing fixtures, combines the different water streams, and then routes the combined stream of water to spout 20. Plumbing fixture 62 receives one stream of water from plumbing fixture 26 via conduit 36 and a second stream of water from a second plumbing fixture (not shown) via conduit 36'.

Plumbing fixture 62 includes a dispensing end 66 which is configured to be fluidly coupled with a receiving end 68 of a conduit 70 that is integrated into spout 20. Plumbing fixture 62 includes a plurality of threads 72 that are configured to facilitate the mounting of plumbing fixture 62 to a body such as countertop 22. Plumbing fixture 62 further includes a mounting flange 74 that facilitates the mounting of plumbing fixture 62 to a body, as discussed below.

Mounting assembly 60 assigns the function of mounting a plumbing fixture to a body to mounting portion 64. Mounting portion 64 has an annular configuration that includes in inner diameter. The inner diameter has a plurality of threads 76 disposed along a surface defining the inner diameter. Plurality of threads 76 are configured to engage plurality of threads 72. In this manner, mounting portion 64 may be screwed onto the threaded portion of plumbing fixture 62. Countertop 22 has an opening that defines a hole 78. In FIG. 6, plumbing fixture 62 is disposed within hole 78 and plurality of threads 76 are in threaded engagement with plurality of threads 72. As mounting portion 64 and plumbing fixture 26 are screwed into threaded engagement with one another, mounting portion 64 and mounting flange 74 are pulled towards one another. As mounting portion 64 and mounting flange 74 are pulled towards one another, a lower surface of mounting portion 64 and an upper surface of mounting flange 74 cooperate to compress countertop 22. In this manner, mounting portion 64 mounts plumbing fixture 62 to countertop 22.

When spout 20 is coupled with mounting portion 64 after mounting portion 64 has been coupled with plumbing fixture 62, dispensing end 66 of plumbing fixture 62 is placed in fluid communication with receiving end 68 of spout 20 and a fluid tight conduit is formed that facilitates the delivery of fluid from plumbing fixture 62 to bowl 16.

Spout 20 includes an opening 80 that extends laterally entirely through an outer wall of spout 20. Mounting portion 64 includes a cavity 82 that extends laterally into a wall of mounting portion 64. Cavity 82 is disposed in a position that aligns with opening 80 when spout 20 is coupled with mounting portion 64. In the illustrated embodiment, a mounting member 84 extends through opening 80 and into cavity 82. In this manner, mounting member 84 affixes spout 20 to mounting portion 64. In some embodiments, spout 20 may include a plurality of openings 80 and mounting portion 64 may include a corresponding plurality of cavities 82 that are disposed to align with plurality of openings 80. In such embodiments, a plurality of mounting members 84 may be employed to affix spout 20 to mounting portion 64. In some embodiments, mounting member 84 may comprise a threaded fastener, such as a flat head screw, a Phillips head screw, a hex head screw, and the like and either or both opening 80 and cavity 82 may include threads to engage with such threaded fastener. As discussed above, other mounting mechanisms such as, but not limited to, retaining rings, pins or buttons may be employed as an alternative to mounting members 84.

So long as mounting member 84 remains in place within cavity 82, spout 20 will remain affixed to mounting portion 64. If spout 20 ever becomes damaged, corroded, decayed or if for any other reason, an unskilled user decides to change out spout 20 (for example, to install a new spout having a different appearance or ornamental design), then all the unskilled user would need to do is to remove mounting member 84 from cavity 82. With mounting member 84 removed, spout 20 may be decoupled from mounting portion 64. When this occurs, mounting portion 64 remains in threaded engagement with plumbing fixture 62 and plumbing fixture 62 remains undisturbed during the changeout or replacement of spout 20.

With continuing reference to FIGS. 1-6, FIG. 7 is a schematic cross-sectional view illustrating the continued engagement between mounting portion 64 and plumbing fixture 62, and consequently, the undisturbed mounting of plumbing fixture 62 to countertop 22 after mounting member 84 has been removed and spout 20 has been decoupled from mounting portion 64. A new spout may now be mounted to mounting portion 64 simply by positioning the new spout over mounting portion 64 and re-inserting mounting member 84. The various components illustrated in FIG. 7 have been illustrated in a manner that depicts gaps between the components. These gaps have been depicted for ease of illustration to better show the relationship between the components and to better show the contours of the components. It should be understood that in embodiments intended for implementation, the various components would be more tightly drawn up against one another and in some embodiments, would be in direct contact with one another.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The ivnention claimed is:

1. A mounting assembly for use with a plumbing fixture, the plumbing fixture comprising a conduit associated with a water source, a dispensing end of the plumbing fixture configured to be coupled with the mounting assembly, the plumbing fixture further configured to be mounted within an opening in a body, the mounting assembly comprising:

a first portion configured to engage the plumbing fixture, to secure the plumbing fixture within the opening in the body, and to support the plumbing fixture such that the dispensing end of the plumbing fixture protrudes beyond the opening in the body; and a second portion configured to be releasably coupled with the first portion.

2. The mounting assembly of claim 1, wherein the first portion is configured for threaded engagement with the plumbing fixture.

3. The mounting assembly of claim 2, wherein the first portion has an annular configuration having an inner diameter and a plurality of threads defined in the inner diameter, the plurality of threads configured for engagement with a corresponding plurality of threads disposed on an outer diameter of the plumbing fixture.

4. The mounting assembly of claim 1, the plumbing fixture including a mounting feature, wherein the first portion is configured to cooperate with the mounting feature to mount the plumbing fixture to the body when the first portion is engaged with the plumbing fixture while the plumbing fixture is disposed within the opening of the body.

5. The mounting assembly of claim 4, wherein the first portion and the mounting feature are configured to compress against opposite surfaces of the body when the first portion is engaged with the plumbing fixture while the plumbing fixture is disposed within the opening in the body.

6. The mounting assembly of claim 1, wherein the second portion has a decorative appearance.

7. The mounting assembly of claim 1, wherein the second portion is configured to conceal the first portion from view when the second portion is engaged with the first portion while the first portion is engaged with the plumbing fixture while the plumbing fixture is mounted within the opening in the body.

8. The mounting assembly of claim 7, wherein the second portion envelopes the first portion when the second portion is engaged with the first portion while the first portion is engaged with the plumbing fixture while the plumbing fixture is mounted within the opening in the body.

9. The mounting assembly of claim 1, wherein the plumbing fixture comprises a selectively operable water source.

10. The mounting assembly of claim 1, further including a threaded fastener, the threaded fastener configured to releasably couple the first portion and the second portion to one another.

11. The mounting assembly of claim 1, wherein the body comprises a counter configured to receive a sink.

12. The mounting assembly of claim 1, wherein the body comprises a sink surround.

13. A mounting assembly for use with a plumbing fixture, the plumbing fixture configured to be mounted within an opening in a body, the mounting assembly comprising:

a first portion configured to engage the plumbing fixture and to secure the plumbing fixture within the opening in the body;

a second portion configured to be releasably coupled with the first portion; and and a handle, wherein the second portion comprises a bezzle, wherein the handle is configured to operably engage the plumbing fixture and to enable a user to selectively operate the plumbing fixture when the handle is engaged with the plumbing fixture, and is further configured to be rotatably mounted to the second portion.

14. The mounting assembly of claim 13, wherein the first portion is configured for threaded engagement with the plumbing fixture.

15. The mounting assembly of claim 13, the plumbing fixture including a mounting feature, wherein the first portion is configured to cooperate with the mounting feature to mount the plumbing fixture to the body when the first portion is engaged with the plumbing fixture while the plumbing fixture is disposed within the opening of the body.

16. The mounting assembly of claim 13, wherein the second portion has a decorative appearance.

17. The mounting assembly of claim 13, wherein the second portion is configured to conceal the first portion from view when the second portion is engaged with the first portion while the first portion is engaged with the plumbing fixture while the plumbing fixture is mounted within the opening in the body.

18. The mounting assembly of claim 17, wherein the second portion envelopes the first portion when the second portion is engaged with the first portion while the first portion is engaged with the plumbing fixture while the plumbing fixture is mounted within the opening in the body.

19. The mounting assembly of claim 13, further including a threaded fastener, the threaded fastener configured to releasably couple the first portion and the second portion to one another.

20. A mounting assembly for use with a plumbing fixture, the plumbing fixture comprising a conduit associated with a water source, a dispensing end of the plumbing fixture configured to be coupled with the mounting assembly, the plumbing fixture further configured to be mounted within an opening in a body, the mounting assembly comprising:

a first portion configured to engage the plumbing fixture, to secure the plumbing fixture within the opening in the body, and to support the plumbing fixture such that the dispensing end of the plumbing fixture protrudes beyond the opening in the body; and a second portion configured to be releasably coupled with the first portion, wherein the second portion comprise a spout.

* * * * *